US005887682A

United States Patent [19]

Zorzi et al.

[11] Patent Number: 5,887,682

[45] **Date of Patent: *Mar. 30, 1999**

[54] BRAKING DEVICE, PARTICULARLY FOR SKATES

[75] Inventors: Claudio Zorzi, Paderno di Ponzano Veneto; Renzo Balbinot, Pieve di Soligo, both of Italy

[73] Assignee: Nordica, S.p.A., Trevignano, Italy

[ * ] Notice: This patent issued on a continued prosecution application filed under 37 CFR 1.53(d), and is subject to the twenty year patent term provisions of 35 U.S.C. 154(a)(2).

[21] Appl. No.: 835,811

[22] Filed: Apr. 16, 1997

Related U.S. Application Data

[63] Continuation of Ser. No. 433,118, May 3, 1995, abandoned.

[30] Foreign Application Priority Data

May 13, 1994 [IT] Italy ..... TV9440050

[51] Int. Cl.[6] ..... B60T 1/14; A63C 17/14

[52] U.S. Cl. ..... 188/5; 280/11.2

[58] Field of Search ..... 188/4 R, 5, 2 D; 280/11.19, 11.2, 11.22, 11.23

[56] References Cited

U.S. PATENT DOCUMENTS

| | | | |
|---|---|---|---|
| 4,275,895 | 6/1981 | Edwards | 280/11.2 |
| 5,211,409 | 5/1993 | Mitchell | 280/11.2 |
| 5,374,070 | 12/1994 | Pellegrini | 280/11.2 |

FOREIGN PATENT DOCUMENTS

| | | |
|---|---|---|
| 0 568 878 A1 | 6/1928 | European Pat. Off. . |
| 0567948 | 11/1993 | European Pat. Off. . |
| 0585764 | 3/1994 | European Pat. Off. . |
| 0594080 | 4/1994 | European Pat. Off. . |

*Primary Examiner*—Lee W. Young
*Attorney, Agent, or Firm*—Hale and Dorr LLP

[57] ABSTRACT

Braking device, particularly for skates including a shoe composed of a quarter articulated to a shell which is in turn associated with a frame, wheels being pivoted thereto. The device is constituted by an elastic support having two essentially L-shaped arms that can be pivoted to the shell or to the frame. The elastic support is slidingly associated with the quarter at one end and a brake is associated with the arms.

24 Claims, 6 Drawing Sheets

BRAKING DEVICE, PARTICULARLY FOR SKATES

This application is a continuation, of application Ser. No. 08/433,118, filed May 3, 1995, now abandoned.

BACKGROUND OF THE INVENTION

The present invention relates to a braking device particularly for skates.

The problem of braking the wheels in order to adjust the speed of the skate is currently felt in conventional roller skates, whether constituted by a shoe associated with a support for two pairs of mutually parallel wheels or constituted by a shoe associated with a supporting frame for aligned wheels.

It is thus known to use adapted blocks or pads, usually made of rubber, which are placed at the toe or heel region of the shoe. When the user tilts the shoe forwards or backwards, the pad interacts with the ground and braking is thus achieved.

However, these solutions have drawbacks, as the user has to rotate the shoe, and therefore the frame associated thereto, at the toe or at the heel, and this can cause a loss of balance with consequent falls.

U.S. Pat. No. 1,402,010 discloses a roller skate having a band that can be fastened on the user's leg above the malleolar region, a rod being connected thereto.

The rod surrounds the rear of the leg and is curved so as to laterally affect the leg. An end of the rod is associated with a lever assembly, at the malleolar region, and the lever assembly is articulated to a structure protruding from the wheel supporting frame.

The lever assembly protrudes at the rear of the frame and is connected to a plate that is shaped approximately complementarily to the curvature of part of an underlying and facing wheel.

This embodiment has drawbacks: first of all, a relative motion occurs between the band and the leg during the sports practice, and this does not make its use comfortable due to the continuous rubbing of the band on the leg.

Furthermore, the plate is activated every time the user bends his leg backwards beyond a given angle, without true and easy possibility of varying this condition.

Furthermore, each user has a different leg shape, and braking is thus achieved for different rotation angles for an equal rod length.

Said rod also acts and presses in the malleolar region, and this can cause discomfort or produce accidental impacts.

Finally, considerable wheel wear is observed.

U.S. Pat. No. 4,275,895 discloses a brake for skates with two mutually parallel pairs of wheels which acts at the rear wheels.

Said brake is constituted by a flap associated with the shoe in a rearward position; a blade is associated in a rearward position with said flap and is pivoted at the supporting frame of the shoe.

Said blade has, at its free end, a transverse element on which two C-shaped elements are formed at the lateral ends; said elements interact, following a backward rotation applied to the flap, with the rear wheels facing said elements, so as to interact with the rolling surface of said wheels.

However, even this solution has drawbacks: it is in fact structurally complicated and therefore difficult to industrialize; it also entails the presence of adapted springs for repositioning the flap in the condition in which the two C-shaped elements do not interact with the wheels, thus further increasing structural complexity.

Furthermore, the structural configuration of the brake causes the two C-shaped elements to interact with the wheel even upon a minimal backward rotation applied to the flap and therefore even for involuntary movements; this produces unwanted braking actions and, accordingly, possible loss of balance or lack of coordination.

Finally, the interaction of the C-shaped element at the rolling surface of the wheels leads to their rapid wear and therefore to non-optimum rolling, which necessarily leads to continuous replacement of said wheels.

U.S. Pat. No. 4,300,781 discloses a braking device for skates that comprise pairs of mutually parallel wheels.

Accordingly, there is a brake constituted by a blade that is pivoted transversely at the rear end of the supporting frame for a shoe; pads are associated with the ends of said blade and face the rolling surface of the pair of rear wheels.

The brake is operated by using a cable to rotate the blade in contrast with a spring associated with the support for the pair of front wheels, so as to move the pads into contact with the rolling surface of the pair of rear wheels.

Said cable is activatable by means of rings or handles associated with a band that can be placed on the user's legs by temporary connection means.

However, this embodiment has considerable drawbacks; first of all, brake activation can lead to possible loss of balance during sports practice, since the body of the user does not assume a position suitable to control the sudden speed reduction; only the skater's hand is in fact involved in the activation of the brake.

Furthermore, as sports practice can occur while wearing trousers, when traction is applied to the rings the band may slip along the trousers or drag them so that they slide along the leg, hindering the braking action.

Furthermore, there is a loose cable that in addition to being a hindrance for the skater, can accidentally catch during racing, especially since coordination of the arm-leg movement moves the legs rhythmically laterally outwards.

U.S. Pat. No. 4,033,596 discloses a roller-ski having, in addition to engagement means for the tip of a shoe, braking means essentially constituted by a bar that protrudes above a supporting frame for the shoe in the rear region thereof, said bar being pivoted transversely to said frame at one end and having, at the other end, a curved plate for supporting the the user's calf.

A frame is associated transversely and to the rear of the bar; once the bar has been rotated backwards, said frame interacts with the rolling surfaces of a pair of wheels in turn freely pivoted to the supporting frame for the shoe.

If using this solution for roller skates, there would be severe drawbacks due to the fact that the sport practiced with a skate entails continuous oscillations of the leg that can lead to unwanted activations of the braking action.

Moreover, the presence of the bar would be dangerous for the user, since it constitutes a blunt body completely independent of the leg which might therefore be dangerous in case of a fall.

Furthermore, the described embodiment does not allow to achieve a gradual braking action.

U.S. Pat. No. 5,388,844 granted on Feb. 14, 1995 discloses a braking device, particularly for skates, comprising a shoe composed of a quarter that is articulated to a shell associated with a supporting frame for one or more wheels.

Said device comprises at least one rod member connected to the quarter and slideable with respect to the shell, said rod member having a fork-like end that interacts with one or more of the wheels beyond a preset backward rotation angle of the quarter.

Although this embodiment is undoubtedly an improvement and is valid, it has some small drawbacks related to the fact that it is not possible to easily achieve good graduality in the braking action, since this is mainly entrusted to the user's skill and sensitivity.

SUMMARY OF THE INVENTION

The principal aim of the present invention is therefore to solve the described technical problems, eliminating the drawbacks described above in conventional skates, by providing a braking device for skates that allows to easily achieve good graduality in the braking action.

Another important object is to provide a braking device that is activatable by the user in case of actual need and therefore not accidentally.

Another important object is to provide a braking device hat is activatable rapidly, simply, and safely by the user without having to perform movements, for example with the hands, that impair balance or coordination.

Another important object is to provide a braking device that protects as much as possible the rolling surface of the wheels from wear.

Another object is to provide a device that in addition to the preceding characteristics is structurally simple, easy to industrialize, reliable and safe in use, and has low manufacturing costs.

This aim, these objects, and others which will become apparent hereinafter are achieved by a braking device, particularly for skates, comprising a shoe composed of a quarter articulated to a shell which is in turn associated with a frame to which a plurality of wheels are pivoted, characterized in that it comprises an elastic support having two essentially L- or S-shaped arms pivoted to said shell or frame, said elastic support being guided with respect to said quarter at one end, a brake being associated between said two arms.

Advantageously, the braking device has means for adjusting the position of the brake with respect to the ground.

BRIEF DESCRIPTION OF THE DRAWINGS

Further characteristics and advantages of the present invention will become apparent from the following detailed description of some particular but not exclusive embodiments thereof, illustrated only by way of non-limitative example in the accompanying drawings, wherein.

DESCRIPTION OF THE PREFERRED EMBODIMENTS

Figure 2:
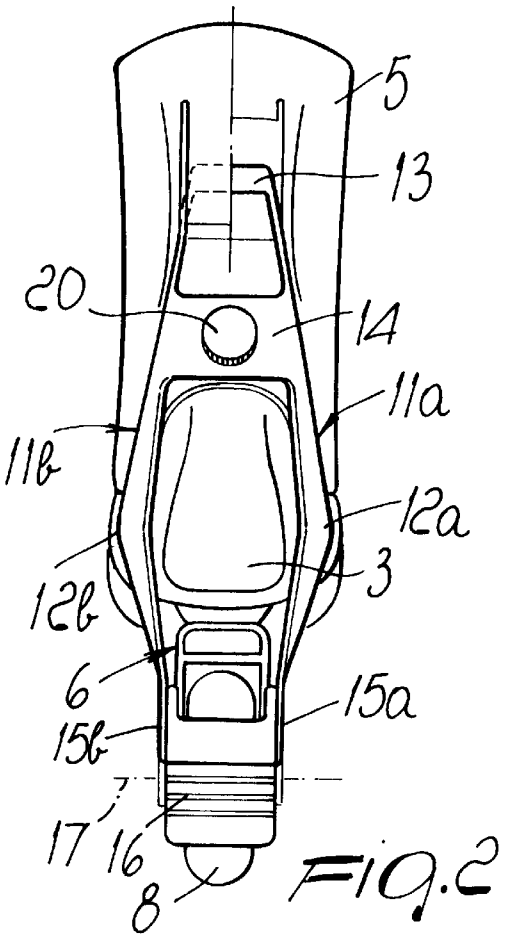
FIG. 2 is a rear view of the skate of FIG. 1.
Figure 1:
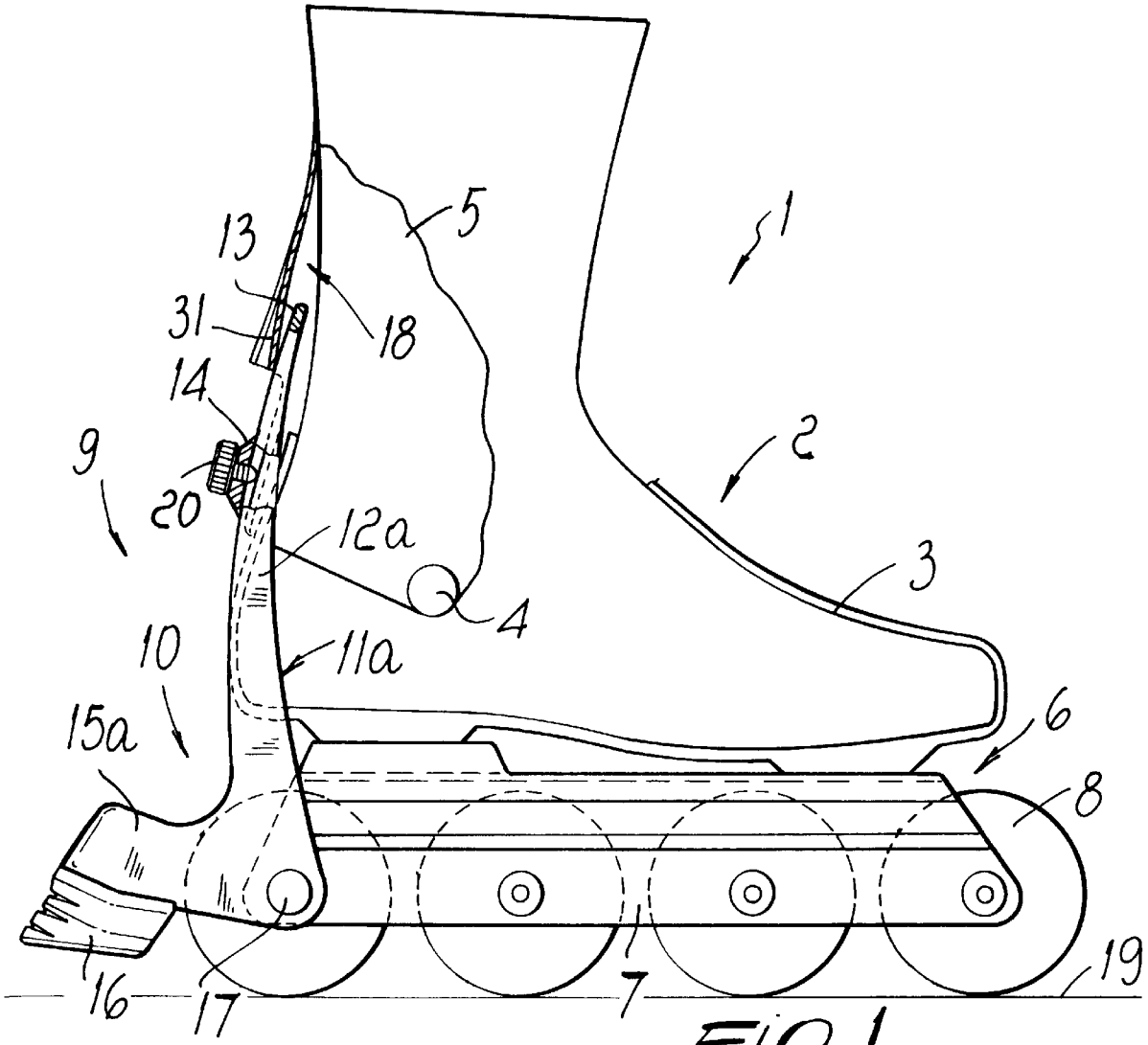
FIG. 1 is a view of the braking device according to the invention.

With reference to the above figures, the reference numeral 1 generally designates a skate comprising a shoe 2 composed of a shell 3 to which at least one quarter 5 is articulated at first studs 4.

The shoe 2 is associated, in a downward region, with a U-shaped frame 6, between the shoulders 7 whereof a plurality of aligned wheels 8 are pivoted.

The braking device, generally designated by the reference numeral 9, is constituted by an elastic support 10 having two essentially L-shaped arms 11*a* and 11*b*.

Said arms 11*a* and 11*b* have first wings 12*a* and 12*b* affecting the rear regions of the quarter 5 and of the shell 3 and are mutually transversely connected by a first cross-member 13 and by a second cross-member 14.

The arms 11*a* and 11*b* also have second wings 15*a* and 15*b* directed away from the frame 6, a brake 16 being associated between said second wings.

The arms 11*a* and 11*b* are also pivoted, at the connection between the first and the second wings, laterally and externally with respect to second studs or pivots 17 for coupling to the shoulders of the frame 6, said studs advantageously corresponding to the pivots of a wheel 8.

The first cross-member 13 is advantageously arranged at an adapted pocket 18 formed at the rear of the quarter 5. The pocket has the purpose of elastically supporting the arms 11*a* and 11*b* so that the brake 16 does not interact with the ground 19, the arms 11*a* and 11*b* being able to rotate freely about the second studs 17.

The pocket 18 comprises a flexible wall constituted by a tab 31 that is connected, in a cantilevered manner, to the quarter 5, the upper end of the support 10 resting on said tab.

The braking device also comprises means for adjusting the position of the brake 16 with respect to the ground 19, said means being constituted for example by an adapted screw 20 rotatably associated at the second cross-member 14, the head whereof can be accessed by the user and the stem whereof can interact by abutment with the facing surface of the quarter 5.

The use of the braking device is thus as follows: after initially associating the first cross-member 13 at the pocket 18 formed on the quarter 5, and after adjusting the screw 20 so that in normal skating conditions the brake 16 does not interact with the ground 19, a backward rotation of the quarter is matched by an equal rotation applied to the arms 11*a* and 11*b*, so as to move the brake 16 into contact with the ground 19; this rotation of the brake is allowed by the elastic deformation of the tab 31, which accordingly acts as an elastic contrast element.

The achieved braking action offers good graduality, since the L-shaped configuration of the arms 11*a* and 11*b* allows to achieve a leaf-spring effect and accordingly a damping of the impact of the brake with the ground.

The particular L-shaped configuration of the arms 11*a* and 11*b* also allows to limit the protrusions of the braking device merely to the second supporting wings 15*a* and 15*b* of the brake, increasing user safety during sports practice.

Furthermore, the possibility of associating the first cross-member 13 at the pocket 18 formed at the rear of the quarter allows to achieve an actual saving in production costs, since assembly is facilitated and moreover a same quarter is usable both in skates that use braking devices and in skates that do not.

Furthermore, the wear of the brake 16 can be compensated by means of the screw 20.

It is thus evident that the invention has achieved the intended aim and objects, a braking device having been obtained that allows the user to achieve optimum graduality in braking and at the same time allows to contain costs by virtue of assembly to the quarter and by virtue of the use of the quarter also for skates that do not have braking devices.

The device according to the invention is of course susceptible of numerous modifications and variations, all of which are within the scope of the same inventive concept.

Figure 3:
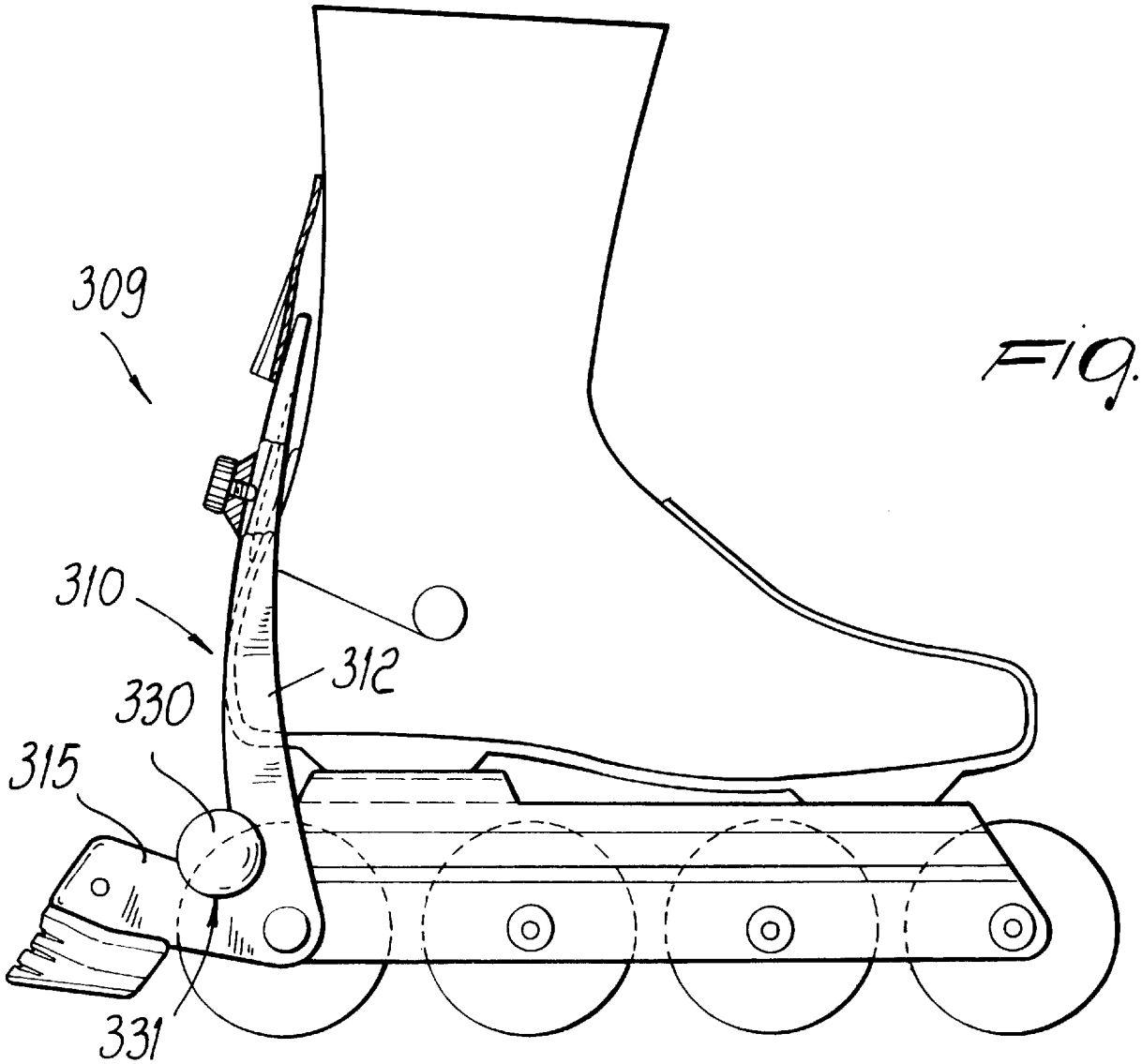
FIG. 3 is a side view of a second embodiment of the device.

Thus, for example, FIG. 3 illustrates a further embodiment, in which the braking device 309 has means for controlling or adjusting the deformation of the support 310 to vary the graduality of the braking action, said means being constituted by a cylinder 330 made of flexible material and removably placeable at a complementarily shaped seat 331 formed at the connection between the first wings 312 and the second wings 315.

Figure 9:
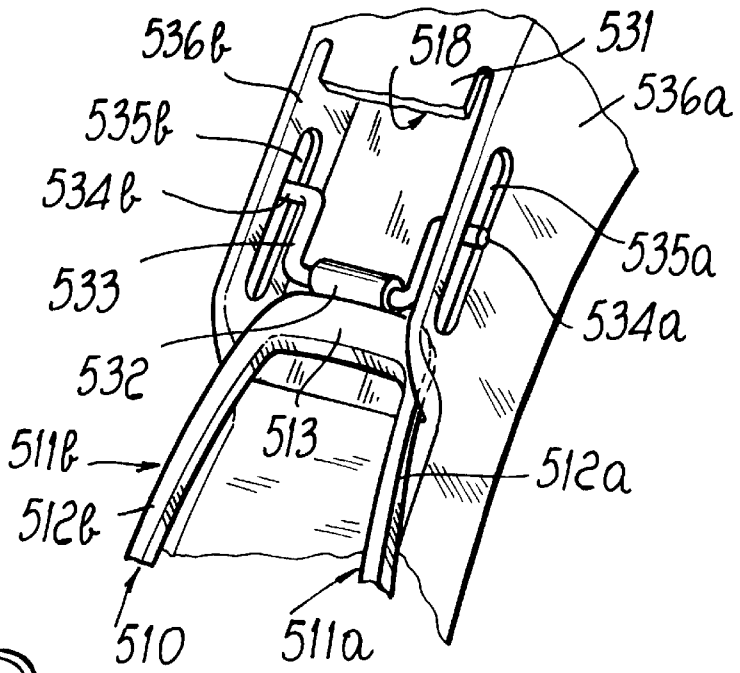
FIG. 9 is a lateral perspective view of a detail of FIG. 4.
Figure 4:
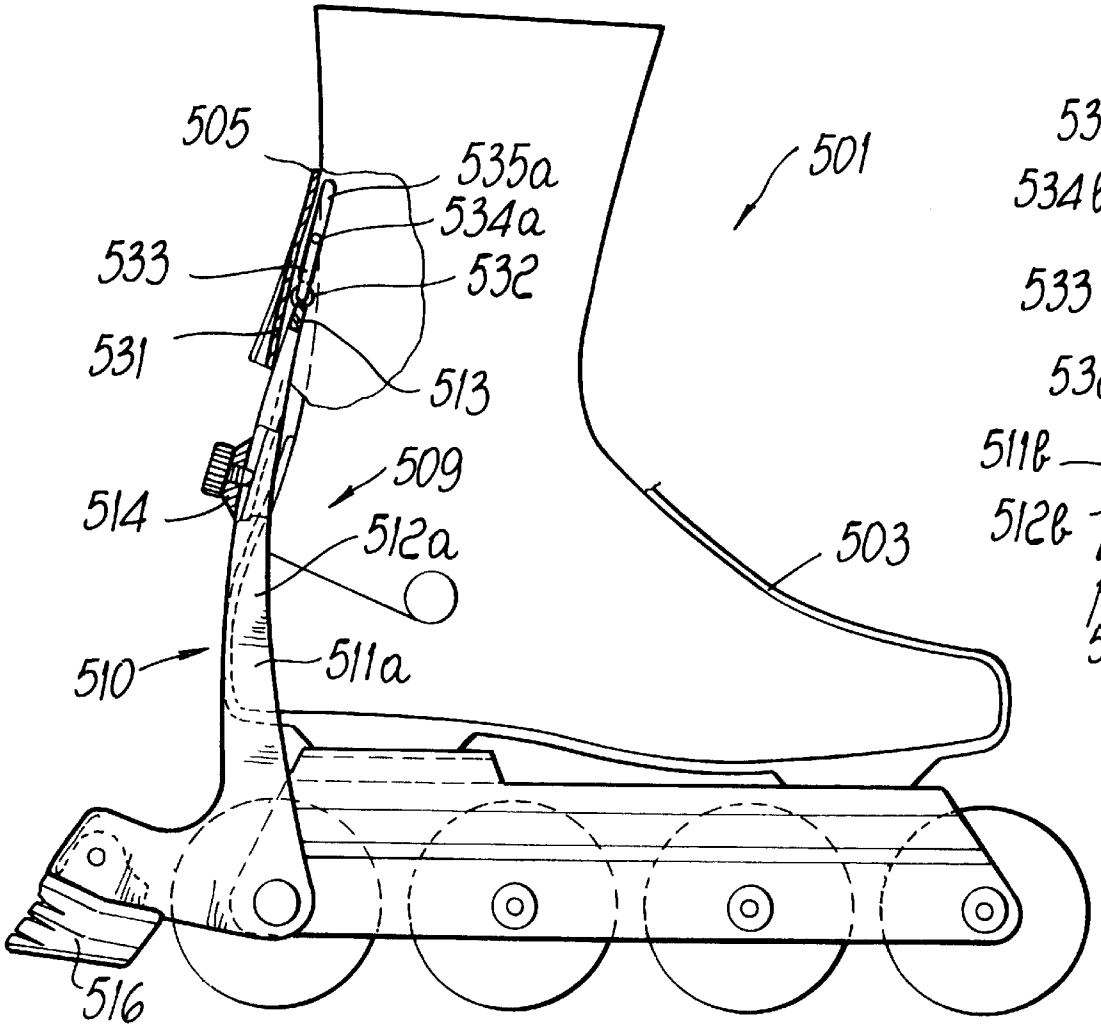
FIG. 4 is a side view of a third embodiment of the device.

FIGS. 4 and 9 show a skate 501 having a braking device 509 constituted by an elastic support 510 that has two essentially L-shaped arms 511*a* and 511*b*.

Said arms 511*a* and 511*b* have first wings 512*a* and 512*b* that affect the rear regions of the quarter 505 and of the shell 503 and are mutually transversely connected by a first cross-member 513 and by a second cross-member 514.

A hollow sleeve 532 is transversely associated with the elastic support 510 at the end of the first cross-member 513 directed away from the second cross-member 514, and an element for connection to the quarter, constituted by an essentially U-shaped metal rod 533, is associated with said sleeve.

Said rod has fifth wings 534*a* and 534*b* slidingly arranged within adapted guiding means that are constituted by a pair of slots 535*a* and 535*b* formed longitudinally with respect to a pair of shoulders 536*a* and 536*b* that are mutually approximately parallel and protrude to the rear of the quarter 505.

The distance between said pair of shoulders is slightly greater than the width of said first cross-member 513, so as to form a seat or pocket 518 inside which the support 510 can slide freely.

The seat or pocket 518 comprises a flexible upper wall interposed between the two shoulders and constituted by a tab 531 that is connected in a cantilevered manner, the upper end of the support 510 resting thereon.

Figure 5:
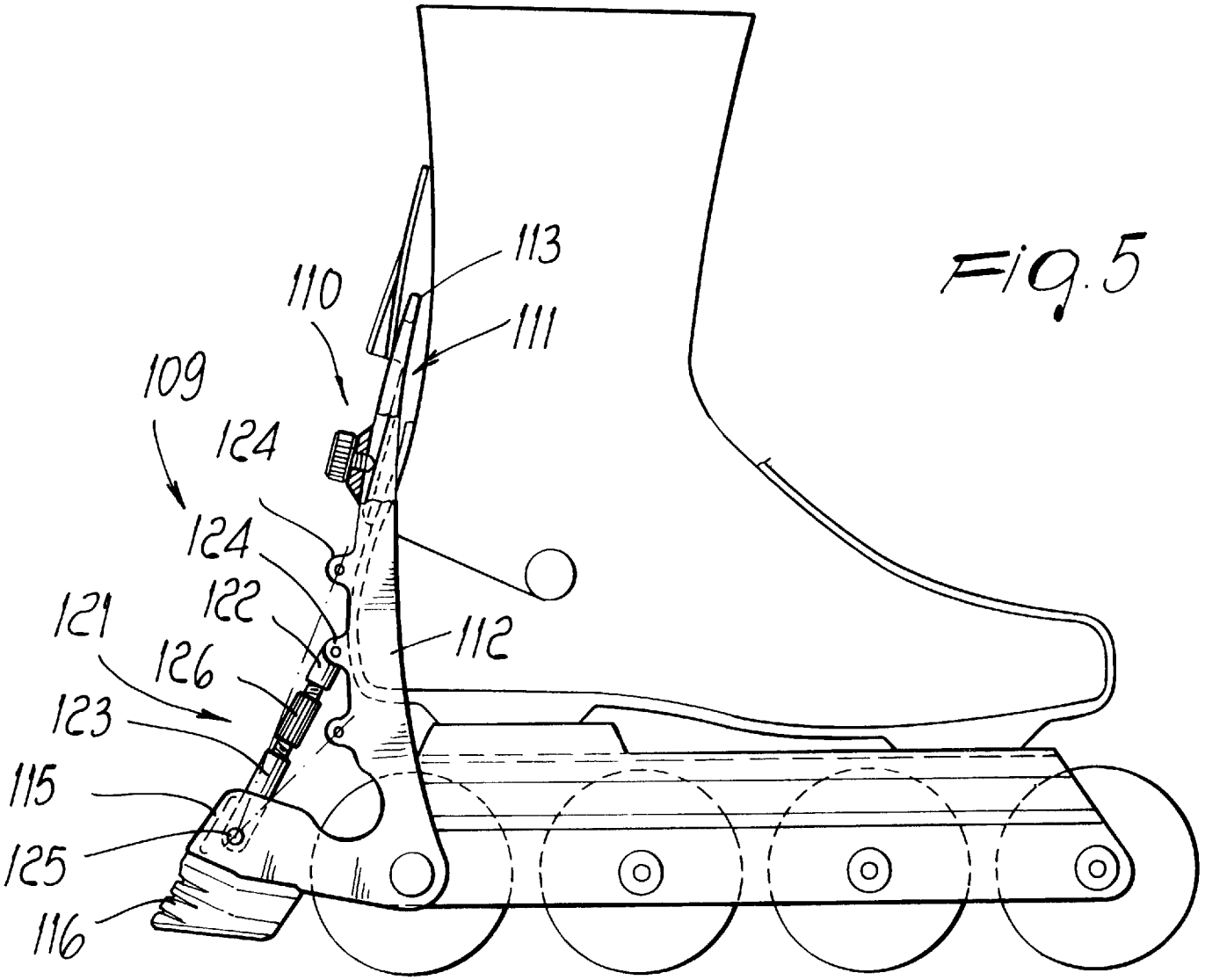
FIG. 5 is a side view of a fourth embodiment of the braking device.

FIG. 5 shows another embodiment, in which the braking device 109 has means for controlling or adjusting the deformation of the support 110 to vary the graduality of the braking action, said means being constituted by an adapted spring or by an adapted strut 121 that is constituted by a first sleeve 122 and by a second sleeve 123 selectively associatable, at one end, respectively at one of multiple pairs of lugs 124 protruding from the first wings 112 and at a pivot 125 located at the ends of the second wings 115 of the arms 111.

The first and second sleeves have right-hand and left-hand or, vice versa, threaded stems, a complementarily shaped bush 126 interacting therewith; the rotation of said bush allows to move the first and second sleeves mutually closer or farther apart.

The pairs of lugs 124 are arranged longitudinally with respect to the first wings 112 of the arms 111; accordingly, for example, by associating the first sleeve 122 at the pair of lugs that is closest to the first cross-member 113 it is possible to achieve a less gradual braking action, since the arms 111 become more rigid.

If instead the first sleeve 122 is associated at the pair of lugs that is closest to the second wings 115, it is possible to achieve a more gradual braking action, since it is again possible to use the deformation between the first and second wings.

Figure 7:
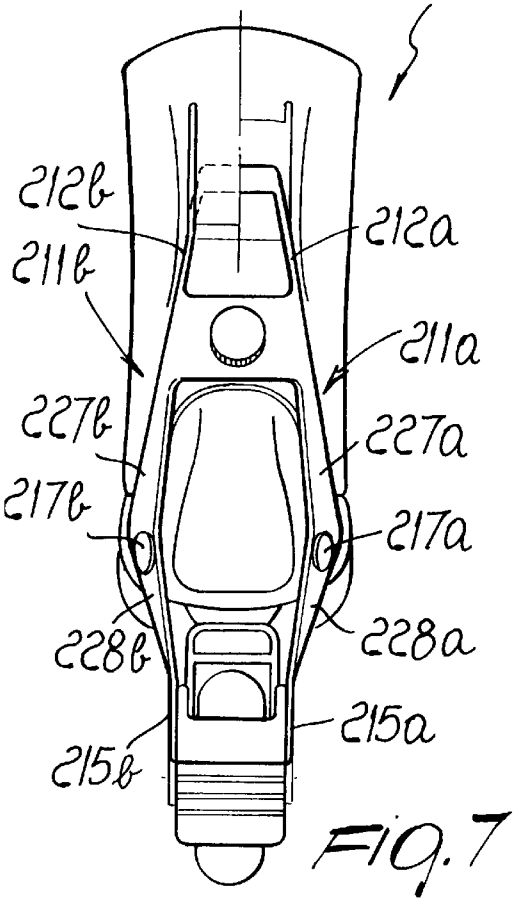
FIG. 7 is a rear view of the embodiment of FIG. 6.
Figure 6:
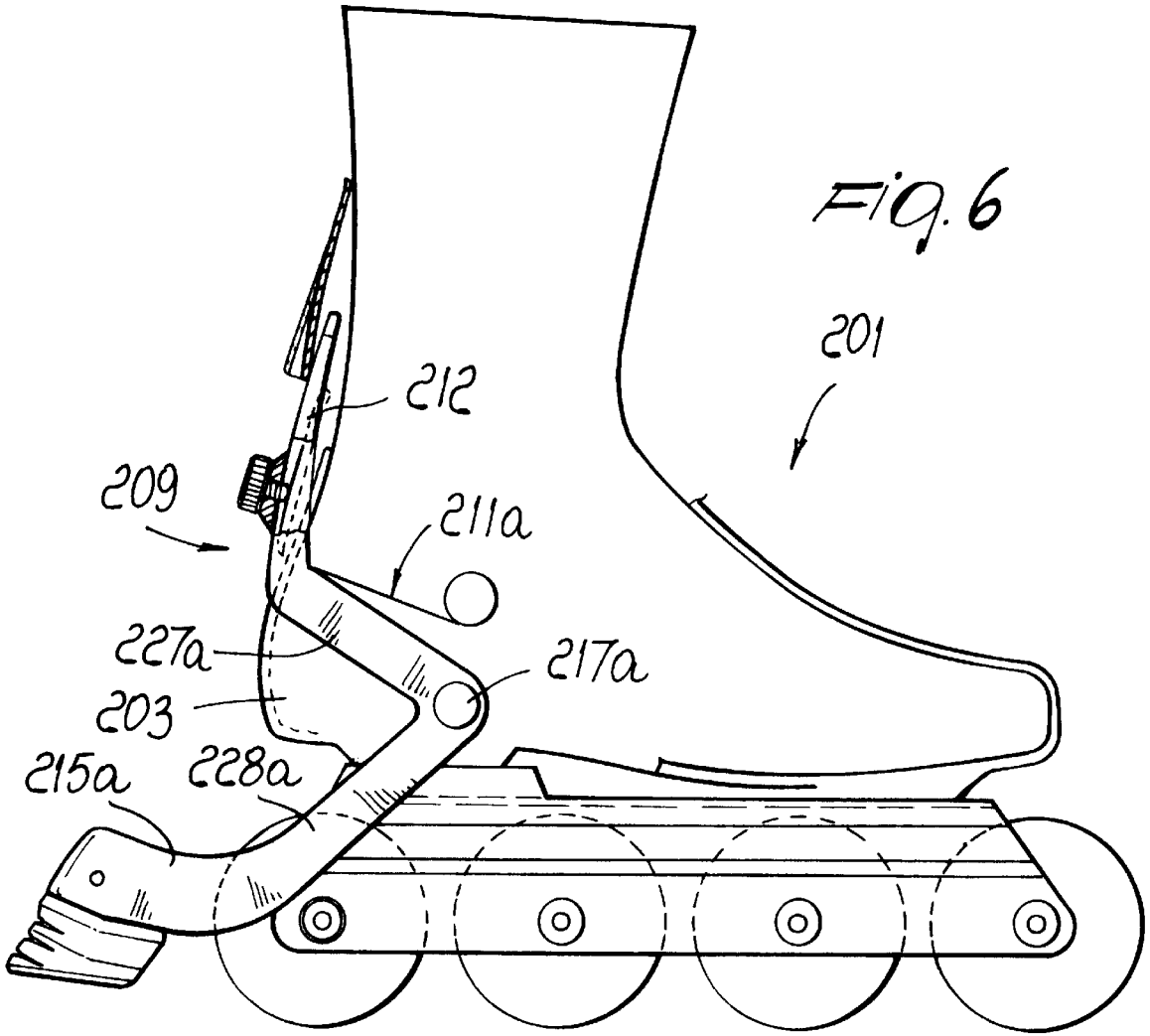
FIG. 6 is a side view of a fifth embodiment.

FIGS. 6 and 7 show another embodiment for a braking device 209, in which the arms 211*a* and 211*b* are essentially S-shaped so as to form third wings 227*a*, 227*b* and fourth wings 228*a*, 228*b* that connect to the first wings 212*a* and 212*b* and to the second wings 215*a* and 215*b* and have, at the connecting region, a point where they are pivoted to the shell 203 of the skate 201 by means of second studs or pivots 217*a*, 217*b*.

Figure 8:
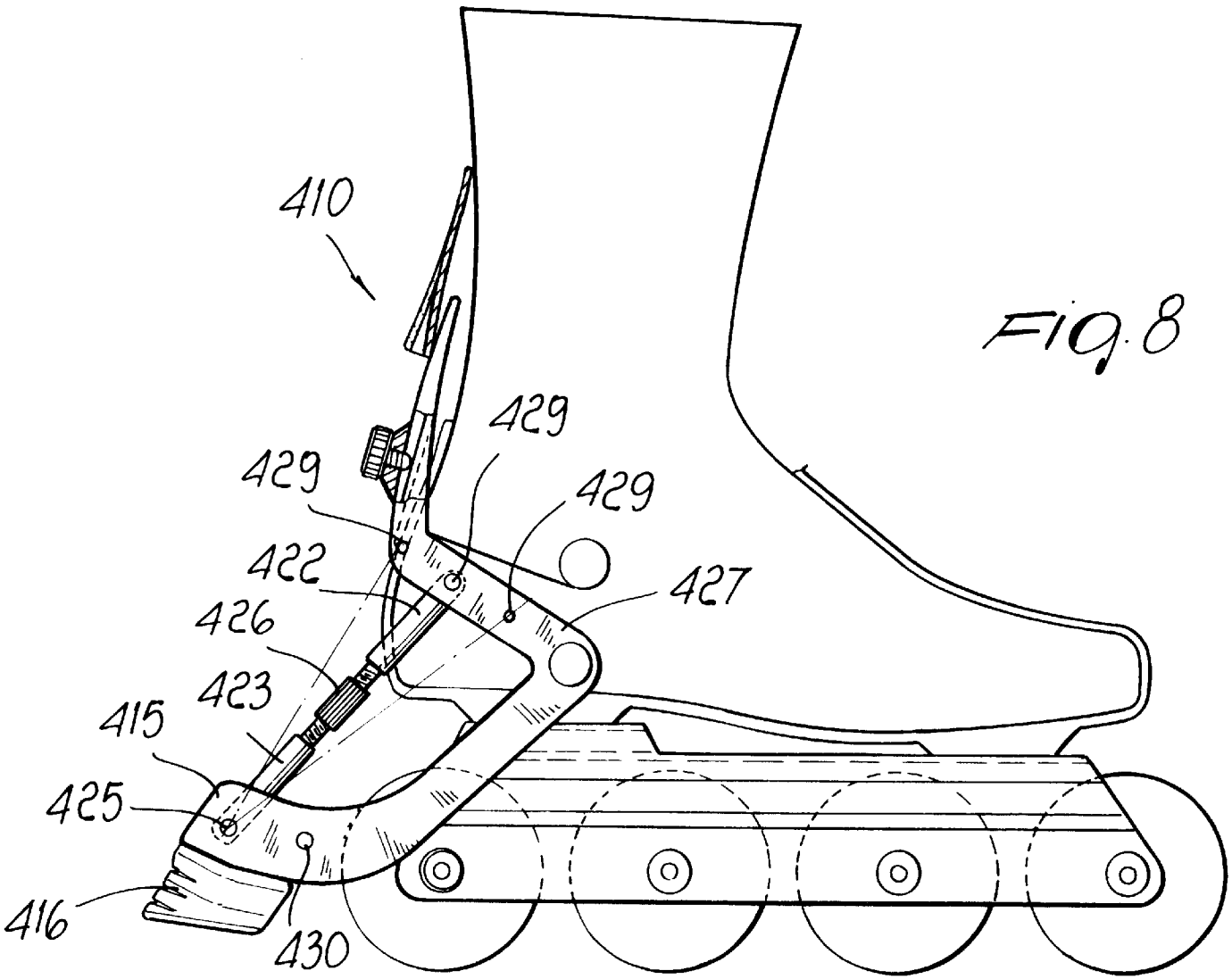
FIG. 8 is a side view of a sixth embodiment.

FIG. 8 illustrates an embodiment similar to that of FIG. 7, but to which has been added means, constituted by a first sleeve 422 and by second sleeve 423, the complementarily threaded stems whereof interact with a complementarily threaded bush 426.

In order to vary the graduality of the braking action, the second sleeve 423 is again associated at the pivot 425, whereas the first sleeve 422 is associatable at one of a plurality of adapted holes 429 formed on one or both of the third wings 427.

Advantageously, the pivot 425 may be arranged in a second hole 430 so as to hinge the second sleeve 423, in order to provide a wider range of adjustment for the elasticity of the support 410.

Of course, the materials used, as well as the dimensions of the individual components of the device, may be the most pertinent according to the specific requirements.

What is claimed is:

1. In a device including:

a frame supporting a plurality of wheels;

a support extending generally upwardly from the frame and arranged to engage the leg of a user, the support being articulated for forward and rearward pivotal movement relative to the frame about a first axis, a braking element positioned generally rearwardly of the support and movable generally upwardly and downwardly relative to the frame, and actuator having a first end adjacent and arranged to engage the support at a point above the first axis, and a second end adjacent and arranged to engage the braking element, the support, braking element and actuator being arranged such that rearward pivotal movement of the support relative to the frame results in movement of the actuator causing the braking element to move downwardly towards a braking position and forward pivotal movement of the support relative the frame permits movement of the actuator that results in the braking element being allowed to move upwardly and away from the braking position, that improvement wherein:

at a point intermediate the first end and the second end of the actuator, the actuator is connected relative to the frame for pivotal movement about a second axis such that pivotal movement of the support about the first axis causes pivotal movement of the actuator about the second axis, portions of the actuator on different sides of said intermediate point form generally an L-shape, and the actuator is elastic such that rearward pivoting of the support causes the actuator to elastically deform.

2. A device according to claim 1, further comprising an adjustor attached to the actuator between the second axis and the first end of the actuator, the adjuster being arranged to engage the support and to vary the relative pivotal position of the actuator relative to the support when the adjuster is in engagement with the support, thereby permitting adjustment of the braking element relative to the braking location.

3. A device according to claim 2 wherein the adjustor comprises a threaded member, and a complementary threaded hole defined by the actuator, the threaded member engaging the support.

4. A device according to claim 1 wherein the actuator includes a pair of actuator elements each of which has a first end adjacent the point above the first axis, and a second end adjacent the braking element, the actuator elements being spaced transversely of the frame and including a cross-member connecting the actuator elements.

5. A device according to claim 4, wherein each of the actuator elements has a vertex, an upper portion extending from the first end of the respective element to the vertex thereof, and a lower portion extending from the second end of the respective element to the vertex thereof, the upper portion of the element moving towards said lower end of said support in response to an rearward pivotal movement of the support when the braking element is in its braking location.

6. A device according to claim 5, further comprising a member interposed between an upper portion and a lower portion of an actuator element for adjusting the deformation of the actuator element in response to rearward pivoting of the support.

7. A device according to claim 6 wherein the member comprises an adjustable member having one end thereof attached to the upper portion of an actuator element between the vertex and first end thereof and another end thereof attached to the lower portion of the actuator element between the vertex and second end thereof.

8. A device according to claim 6 wherein the member is a spring.

9. A device according to claim 6, wherein the member comprises a flexible member removably placed in a complementary shaped seat formed at the vertex of said upper and lower portions of the actuator element.

10. A device according to 2, wherein the actuator has first, second, third and fourth wings, the third and fourth wings having upper and lower ends, the first wing and the third wing defining a first vertex, the third wing and the fourth wing defining a second vertex, the fourth wing and the second wing defining a third vertex, the first wing extending from the first end of said support to the first vertex, the third wing extending from the first vertex to the second vertex, the fourth wing extending from the second vertex to the third vertex, the second wing extending from the third vertex to the second end of said support.

11. A device according to claim 10, further comprising a longitudinally-extending member interposed between two of the wings.

12. A device according to claim 1 including an elastic element connected to the support adjacent the first end of the actuator, the elastic element elastically engaging the first end of the actuator and acting as an elastic contrast element upon backward rotation of the support.

13. A device according to claim 12 wherein the elastic element defines a pocket and the first end of the actuator is positioned within the pocket.

14. A device according to claim 12 wherein the elastic element comprises a flexible wall connected in a cantilever manner to the support, the first end of the actuator engaging the elastic element.

15. A device according to claim 12 further comprising a pair of shoulders extending from the actuator to the elastic element, the shoulders being approximately parallel to each other, and the distance between the shoulders being greater than the width of the first end of the actuator.

16. In a device including:

a frame supporting a plurality of wheels;

a support extending generally upwardly from the frame and arranged to engage the leg of a user, the support being articulated for forward and rearward pivotal movement relative to the frame about a first axis, a braking element positioned generally rearwardly of the support and movable generally upwardly and downwardly relative to the frame, and an actuator having a first end adjacent and arranged to engage the support at a point above the first axis, and a second end adjacent and arranged to engage the braking element, the support, braking element and actuator being arranged such that rearward pivotal movement of the support relative to the frame results in movement of the actuator causing the braking element to move downwardly towards a braking position and forward pivotal movement of the support relative the frame permits movement of the actuator that results in the braking element being allowed to move upwardly and away from the braking position, that improvement wherein:

at a point intermediate the first end and the second end of the actuator, the actuator is connected relative to the frame for pivotal movement about a second axis such that pivotal movement of the support about the first axis causes pivotal movement of the actuator about the second axis, and an elastic element is connected to the support adjacent the first end of the actuator, the elastic element elastically engaging the first end of the actuator and acting as an elastic contrast element upon backward rotation of the support.

17. A device according to claim 16 wherein the elastic element defines a pocket and the first end of the actuator is positioned within the pocket.

18. A device according to claim 16 wherein the elastic element comprises a flexible wall connected in a cantilever manner to the support, the first end of the support engaging the elastic element.

19. A device according to claim 16 further comprising a pair of shoulders extending from the actuator to the elastic element, the shoulders being approximately parallel to each other, and the distance between the shoulders being greater than the width of the first end of the actuator.

20. In a device including:

a frame supporting a plurality of wheels;

a support extending generally upwardly from the frame and arranged to engage the leg of a user, the support being articulated for forward and rearward pivotal movement relative to the frame about a first axis, a braking element positioned generally rearwardly of the support and movable generally upwardly and downwardly relative to the frame, and an actuator having a first end adjacent and arranged to engage the support at a point above the first axis, and a second end adjacent and arranged to engage the braking element, the support, braking element and actuator being arranged such that rearward pivotal movement of the support relative to the frame results in movement of the actuator causing the braking element to move downwardly towards a braking position and forward pivotal movement of the support relative the frame permits movement of the actuator that results in the braking element being allowed to move upwardly and away from the braking position, that improvement wherein:

at a point intermediate the first end and the second end of the actuator, the actuator is connected relative to the frame for pivotal movement about a second axis such that pivotal movement of the support about the first axis causes pivotal movement of the actuator about the second axis, portions of the actuator on different sides of the second axis form essentially an L-shape, the actuator is elastic such that rearward pivoting of the support causes the actuator to elastically deform, the actuator includes a pair of actuator elements each of which has a first end adjacent the point above the first axis, and a second end adjacent the braking element, the actuator elements being spaced transversely of the frame and including a cross-member connecting the actuator elements, and the cross-member is arranged at an adapted pocket formed to the rear of the support, the pocket being suitable to support the actuator elements, which can pivot freely about the second axis, so that the braking element is positioned away from the braking location.

21. The device of claim 20 including an adjuster for adjusting the position of the braking element with respect to the braking location, the adjuster being constituted by an adapted screw which is rotatably associated at a second cross-member connecting the actuator elements, the screw having a head that can be accessed by a user and a stem that interacts by abutment with a facing surface of the support.

22. In a device including:

a frame supporting a plurality of wheels;

a support extending generally upwardly from the frame and arranged to engage the leg of a user, the support being articulated for forward and rearward pivotal movement relative to the frame about a first axis, a braking element positioned generally rearwardly of the support and movable generally upwardly and downwardly relative to the frame, and an actuator having a first end adjacent and arranged to engage the support at a point above the first axis, and a second end adjacent and arranged to engage the braking element, the support, braking element and actuator being arranged such that rearward pivotal movement of the support relative to the frame results in movement of the actuator causing the braking element to move downwardly towards a braking position and forward pivotal movement of the support relative the frame permits movement of the actuator that results in the braking element being allowed to move upwardly and away from the braking position, that improvement wherein:

at a point intermediate the first end and the second end of the actuator, the actuator is connected relative to the frame for pivotal movement about a second axis such that pivotal movement of the support about the first axis causes pivotal movement of the actuator about the second axis, portions of the actuator on different sides of the second axis form generally an L-shape, the actuator is elastic such that rearward pivoting of the support causes the actuator to elastically deform, a plurality of pairs of lugs protrude from the actuator between the second axis and the first end of the actuator, for controlling or adjusting the deformation of the actuator to vary the graduality of the braking action, a first sleeve and a second sleeve are selectively associated respectively at one of the a plurality of pairs of lugs and at a pivot adjacent the braking element and the second end of the actuator.

23. A device according to claim 22 wherein the first and second sleeves have right-hand and left-hand threaded stems or vice versa, a complementary threaded bush interacting with the stems, the rotation of the bush allowing the mutually spacing or approach of the first and second sleeves.

24. A device according to claim 22 wherein the pairs of lugs are arranged longitudinally with respect to the actuator.

* * * * *